US005173575A

United States Patent [19]

Furukawa

[11] Patent Number: 5,173,575

[45] Date of Patent: Dec. 22, 1992

[54] ACOUSTIC APPARATUS

[75] Inventor: Kazunari Furukawa, Hamamatsu, Japan

[73] Assignee: Yamaha Corporation, Hamamatsu, Japan

[21] Appl. No.: 326,880

[22] Filed: Mar. 21, 1989

[30] Foreign Application Priority Data

Mar. 25, 1988 [JP] Japan ..... 63-38440
Jul. 22, 1988 [JP] Japan ..... 63-96437

[51] Int. Cl.[5] ..... H04R 1/28

[52] U.S. Cl. ..... 181/160; 181/148; 181/156; 381/94; 381/96; 381/159

[58] Field of Search ..... 181/141, 148, 155, 156, 181/160; 381/28, 93, 94, 96, 98, 159, 97, 100, 103, 106, 108, 120, 121, 153, 154, 158, 162

[56] References Cited

U.S. PATENT DOCUMENTS

| | | | |
|---|---|---|---|
| 2,887,532 | 5/1959 | Werner . | |
| 3,037,081 | 5/1962 | Carlsson . | |
| 3,122,215 | 2/1964 | Sutton | 181/160 |
| 3,821,473 | 6/1974 | Mullins . | |
| 3,984,635 | 10/1976 | Nestorovic | 381/97 X |
| 4,118,600 | 10/1978 | Stahl . | |
| 4,126,204 | 11/1978 | Ogi et al. | 181/156 |
| [illegible]135,600 | 1/1979 | Ogi et al. | 181/156 |
| [illegible]2,609 | 3/1979 | Johnson | 181/156 |
| [illegible].706 | 12/1979 | Bakgaard . | |
| [illegible]959 | 2/1986 | Prophit | 181/156 |
| [illegible]40 | 4/1988 | Kaizer | 381/103 |
| [illegible]82 | 7/1988 | Hudson, III | 181/156 |
| [illegible]82 | 6/1990 | Tanaka | 181/156 X |

FOREIGN PATENT DOCUMENTS

| | | | |
|---|---|---|---|
| 2448088 | 10/1974 | Fed. Rep. of Germany | 181/148 |
| 2854899 | 7/1980 | Fed. Rep. of Germany | 181/156 |
| 1201682 | 1/1960 | France | 181/156 |
| 2433268 | 10/1978 | France . | |
| 104979 | 9/1938 | United Kingdom | 181/156 |

OTHER PUBLICATIONS

"Effect of a Negative Impedance Source on Loudspeaker Performance" by Richard E. Werner, The Journal of The Acoustical Society of America; vol. 29, No. 3, Mar. 1957.

"Application of Negative Impedance Amplifiers to Loudspeaker Systems", R. E. Werner and R. M. Carrell; Journal of The Audio Engineering Society; vol. 6, No. 4, Oct., 1958.

"A New Approach to Loudspeaker Damping", Warner Clements, Audio Engineering; Aug., 1951.

"Loudspeakers in Vented Boxes: Part I", A. N. Thiele, Journal of Audio Engineering Society, pp. 382-392, May 1971, vol. 19, No. 5.

"Loudspeakers in Vented Boxes: Part II", A. N. Thiele, Journal of Audio Engineering Society, pp. 471-483, Jun. 1971, vol. 19, No. 6.

"The Search for an Optimum Transmission Line Speaker" by W. J. Hoge, *Audio*, vol. 61, No. 8, Aug. 1977.

*Primary Examiner*—Benjamin R. Fuller

*Attorney, Agent, or Firm*—Spensley, Horn, Jubas & Lubitz

[57] ABSTRACT

A compact acoustic apparatus in which a vibrator is arranged in a Helmholtz resonator having a resonance port, and is driven to radiate a resonant acoustic wave so as to perform lower bass sound reproduction, is characterized in that a cabinet is reduced in size by externally projecting the resonance port from the cabinet, and/or a boundary condition change buffer means is arranged at an opening portion of the resonance port to prevent noise caused by an air flow flowing through the resonance port.

4 Claims, 5 Drawing Sheets

FIG. 9C
FIG. 9B
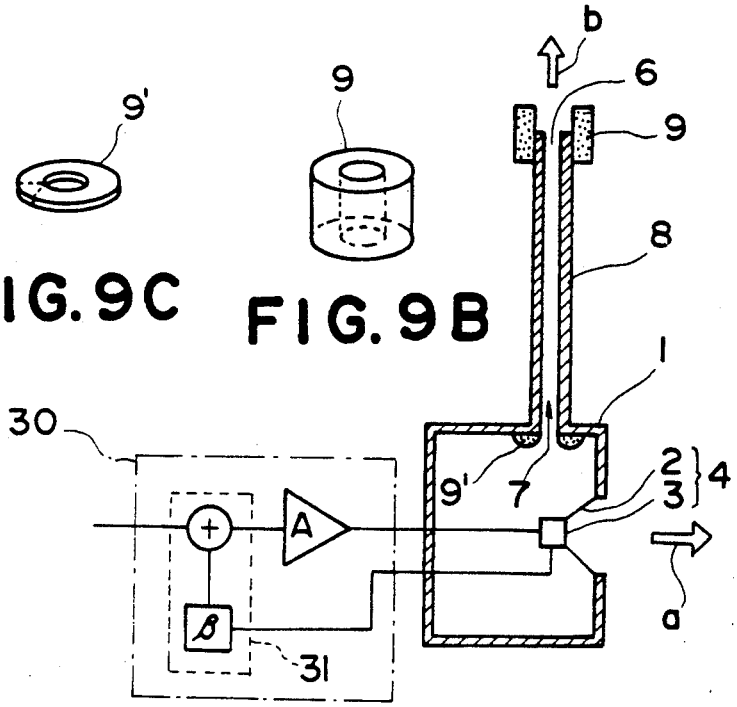
FIG. 9A
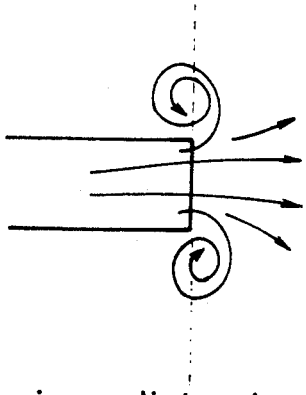
immediate change at boundary
FIG. 10B
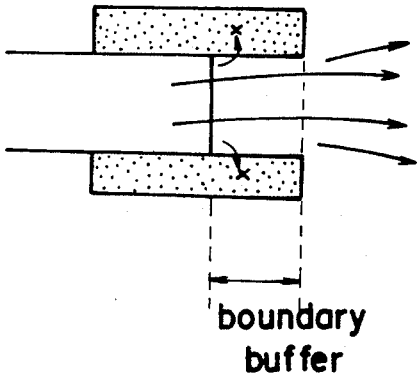
FIG. 10A

ACOUSTIC APPARATUS

BACKGROUND OF THE INVENTION

1. Field of the Invention

The present invention relates to an acoustic apparatus in which a vibrator is arranged in a Helmholtz's resonator having a resonance port comprising an open duct, and is driven to radiate a resonant acoustic wave and, more particularly, to an acoustic apparatus in which the vibrator is driven to cancel an air reaction from the resonator side when the Helmholtz resonator is driven, thereby allowing lower base sound reproduction using a smaller cabinet.

2. Description of the Prior Art

As an acoustic apparatus solely utilizing a Helmholtz's resonance, a phase-inversion (bass-reflex) speaker system is known. FIGS. 13A and 13B are respectively a perspective view and a sectional view showing an arrangement of the bass-reflex speaker system. In the speaker system shown in FIGS. 13A and 13B, a hole is formed in the front surface of a cabinet 1, a vibrator (speaker unit) 4 consisting of a diaphragm 2 and a dynamic speaker 3 is mounted in the hole, and an open duct port (resonance port) 8 having a sound path 7 whose opening 6 is open to an external portion is formed therebelow. In the bass-reflex speaker system according to the conventional basic design, a resonance frequency (antiresonance frequency) $f_{OP}$ defined by an air spring of the cabinet 1 and an air mass in the sound path 7 is set to be lower than a lowest resonance frequency $f_{OC}$ of the vibrator 4 when the vibrator is assembled in the bass-reflex enclosure, and in some cases, lower than a lowest resonance frequency $f_O$ inherent to the vibrator. At a frequency higher than the antiresonance frequency $f_{OP}$, the phase of sound pressure from the rear surface of the diaphragm 2 is inverted at the sound path 7. Consequently, in front of the cabinet 1, a sound directly radiated from the front surface of the diaphragm 2 is in phase with a sound from the opening 6, and these sounds are in-phase added to each other, thus increasing the sound pressure. As a result of the in-phase addition, the lowest resonance frequency of the system is expanded to the antiresonance frequency $f_{OP}$ of the resonator, and according to an optimally designed bass-reflex speaker system, the frequency characteristics of the output sound pressure can be expanded to the resonance frequencies $f_{OC}$ and $f_O$ of the vibrator 4 or less. As indicated by an alternate long and two short dashed curve in FIG. 14, a uniform reproduction range can be widened as compared to an infinite plane baffle or closed baffle.

In the bass-reflex speaker system, a frequency of an antiresonance (resonance) is as low as 50 to 100 Hz. Thus, a wavelength of a sound is long, and an interference due to a difference in distance between the front surface of the diaphragm 2 and the opening 6, i.e., an interference between two sound generation sources, is not conspicuous. In particular, in view of the dimensions of a normal speaker cabinet, the speaker system can hardly have a propagation difference (an odd-number multiple of a half wavelength) large enough to achieve opposite phase cancellation. However, in the conventional bass-reflex speaker system, a phase relationship has a primary importance in principle, and in order to accurately perform in-phase addition, the two sound generation sources, i.e., the diaphragm 2 and the opening 6 should be arranged parallel on a single plane, in particular, on the front surface of the cabinet facing to reproduce sound radiation direction at the same level. If the length of the resonance port 8 is increased in order to further increase the bass sound reproduction range and the like and the propagation difference is increased, a problem of an interference is inevitably posed.

In the conventional speaker system, a large cabinet must be basically used to satisfactorily reproduce a bass sound, and no means can eliminate this drawback. Although the bass-reflex speaker system can reproduce a lower bass range than a closed speaker system if the cabinet volume remains the same, a large cabinet to some extent is normally used. The antiresonance frequency $f_{OP}$ is given by:

$$f_{OP}=c(S/lV)^{\frac{1}{2}}/2\pi \quad \ldots (1)$$

where c is the sonic speed, S is the sectional area of the resonance port 8 (area of the opening 6), l is the length of the port 8, and V is the volume of the cabinet 1.

Therefore, since the cabinet volume V is large and hence S/l can be large accordingly, the resonance port 8 for realizing a low antiresonance frequency $f_{OP}$ can be short. For this reason, there is no problem when the diaphragm 2 and the opening 6 are arranged parallel on the front surface of the cabinet 1 at the same level. Thus, the port 8 has never become too long to be assembled in the cabinet. For example, the port length has never exceeded the depth of the cabinet 1.

A resonance frequency $f_{OP}$ of a Helmholtz's resonator constituted by the cabinet 1 and the resonance port 8 may be extremely decreased regardless of the basic concept of a bass-reflex speaker system. In this case, in a drive method using a conventional power amplifier, the Q value of the speaker unit is increased and the Q value of the resonator is decreased due to mutual dependency of the speaker unit and the resonator. Thus, a sufficient bass sound resonance radiation power of the resonator cannot be assured. Such a change in Q value is conspicuous as the diameter of the resonance port 8 is decreased or as its length is increased or when the port 8 is bent or the opening portion at the trailing end of the port 8 approaches the inner surface of the cabinet by a distance equal to or smaller than the inner diameter of the port. Therefore, in the conventional bass-reflex speaker system, it is considered to be impossible or very difficult to render the cabinet compact and to expand the bass sound reproduction range so that the resonance port 8 must be lengthened and bent or project from the front surface of the cabinet.

SUMMARY OF THE INVENTION

It is a first object of the present invention to provide a compact acoustic apparatus which can perform lower bass sound reproduction, and has a large margin in a sound source layout in consideration of the conventional problems.

In order to achieve the first object, according to a first aspect of the present invention, an acoustic apparatus in which a vibrator is arranged in a Helmholtz's resonator having a resonance port and is driven to radiate a resonance acoustic wave is characterized in that the vibrator is driven to cancel an air reaction from the resonator side when the Helmholtz's resonator is driven, and the resonance port externally projects from the Helmholtz's resonator.

In the first aspect of the present invention with the above arrangement, the vibrator is driven to cancel an air reaction from the resonator side when the Helmholtz resonator is driven. That is, since the vibrator is driven in a sufficiently damped state, i.e., in a so-called "dead" state without being influenced by the air reaction from the resonator side, i.e., the cabinet side, the frequency characteristics of the directly radiated acoustic wave are not influenced by the volume of the cabinet. Therefore, the volume of the cabinet can be reduced as long as the cabinet can serve as a cavity of the Helmholtz resonator and a chamber of the vibrator. To drive the vibrator to cancel the air reaction from the resonator side when the Helmholtz resonator is driven implies that the diaphragm of the vibrator is an equivalent wall which cannot be driven by the resonator side when viewed from the resonator. Therefore, the Q value of the Helmholtz resonator is not influenced by the characteristics of the vibrator, and if the resonance frequency $f_{OP}$ is decreased, a sufficiently high Q value can be assured. The influence of an increase in acoustic resonance of the resonance port on the Q value of the resonator can be eliminated as compared to the case of mutual dependency. For this reason, according to the first aspect of the present invention, the cabinet 1 and hence, the entire system are rendered compact, and a lower bass sound than that from the conventional bass-reflex speaker system can be reproduced.

In this case, in order to make the cabinet compact and to decrease the resonance frequency $f_{OP}$ of the resonator, S/l in equation (1) must be reduced, and there is a high possibility that the length l of the resonance port 8 becomes larger than that of the cabinet main body. When the resonance port is bent several times and housed in the cabinet, an acoustic resistance is increased, and as a result, the resonance Q value is decreased. However, if the resonance port projects from the cabinet, a decrease in resonance Q value caused by bending can be prevented.

According to the first aspect of the present invention, the cabinet can be rendered compact, and a lower bass sound can be reproduced. For this reason, if the resonance port is lengthened, the bass sound range characteristics are less deteriorated. More specifically, when the resonance port projects from the cabinet, the system can be further rendered compact. Since the vibrator (speaker unit) and the resonance port independently radiate acoustic waves of their sharing ranges, the phase relationship between the two sound sources need not be basically considered. Therefore, the relative positional relationship between the vibrator and the opening portion of the resonance port can be arbitrarily determined.

Furthermore, since the resonance port projects from the cabinet, the opening direction of the resonance port can be varied, and setting according to a user's favor can be performed depending on a reproduction environment.

In the acoustic apparatus according to the first aspect of the present invention, if the cabinet 1 is rendered compact, a lower bass sound (resonance sound) having a sufficient level can be generated from the Helmholtz's resonator. However, if the resonance port is elongated to achieve a setting capable of allowing both a compact system and lower bass sound reproduction, an uncomfortable turbulent sound is generated at the opening portion of the port, and becomes noise, thus degrading the quality of the acoustic apparatus.

When the resonance port is elongated, an air flow velocity in the port is extremely increased, and a boundary condition at the opening portion is abruptly changed. Thus, the turbulent or vortex flow of air may be frequently generated. In some cases, the turbulent flow is sensed as noise.

The turbulent flow at the opening portion of the resonance port is also present more or less at the opening portion of the resonance port of the conventional bass-reflex speaker system. However, since the velocity of the port air flow in the conventional bass-reflex speaker system is not so large, it does not pose a serious problem. However, when the vibrator is driven to cancel the air reaction from the resonator side, the air flow rate and the turbulent flow are increased beyond those in the conventional system since the cabinet is rendered compact, the resonance port is elongated, and the Q value, i.e., acoustic radiation power of the resonator is considerably increased. In particular, when the resonance port externally projects from the cabinet, since the boundary condition is largely changed, the turbulent flow and the like are more frequently generated.

A second aspect of the present invention is achieved in consideration of the above problem, and has as its second object to prevent generation of an uncomfortable turbulent sound at an opening portion of a resonance port in an acoustic apparatus in which a vibrator is arranged in a Helmholtz's resonator having a resonance port and is driven to radiate a resonance acoustic wave.

In order to solve the above-mentioned problem, according to the second aspect of the present invention, the opening portion of the resonance port of the Helmholtz's resonator comprises a boundary condition change buffer means.

The acoustic apparatus according to the second aspect of the present invention comprises the boundary condition change buffer means. Thus, even if an air flow velocity in the resonance port is high, a change in boundary condition is moderated, and the turbulent flow is not easily generated.

Therefore, according to the second aspect of the present invention, noise such as a turbulent sound can be eliminated or prevented, and quality of the acoustic apparatus can be improved.

BRIEF DESCRIPTION OF THE DRAWINGS

FIGS. 9A, 9B, and 9C are views showing an acoustic apparatus according to a second embodiment of the present invention;

FIGS. 10A and 10B are views for explaining changes in boundary condition in the acoustic apparatuses shown in FIGS. 9 and 1, respectively;

DESCRIPTION OF THE PREFERRED EMBODIMENTS

Figure 1:
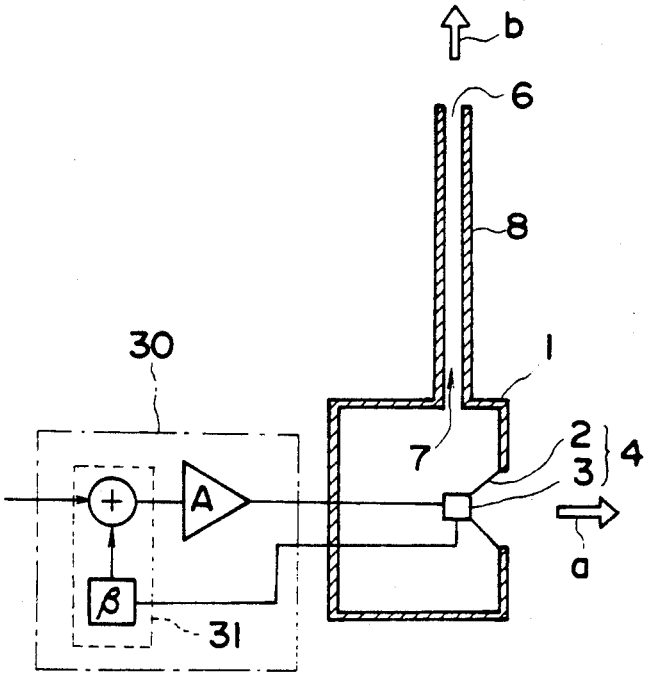
FIG. 1 is a diagram showing an acoustic apparatus according to a first embodiment of the present invention.
Figure 2:
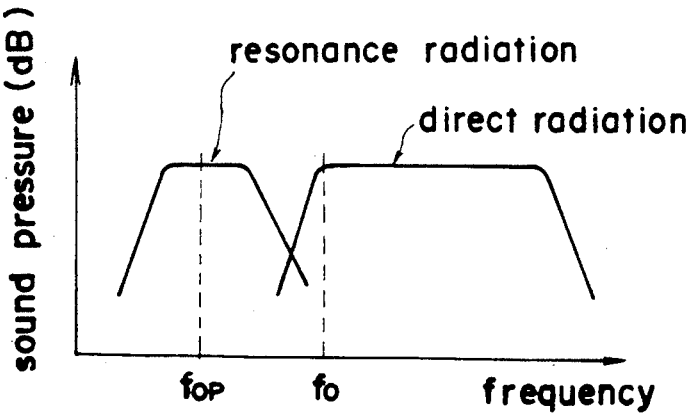
FIG. 2 is a graph showing frequency characteristics of a sound pressure of an acoustic wave radiated from the acoustic apparatus shown in FIG. 1.

Preferred embodiments of the present invention will now be described with reference to FIGS. 1 to 12B. The same reference numerals denote common or corresponding parts in the prior art shown in FIGS. 13A and 13B.

First Embodiment

FIG. 1 shows an arrangement of an acoustic apparatus according to a first embodiment of the present invention. In the acoustic apparatus (speaker system) shown in FIG. 1, a hole is formed in the front surface of a cabinet 1, and a vibrator 4 consisting of a diaphragm 2 and a dynamic electro-acoustic converter (speaker) 3 is mounted in the hole. A resonance port 8 which projects from the cabinet 1 and has a sound path 7 whose opening 6 is open to an external portion is arranged on the upper portion of the cabinet 1. The resonance port 8 and the cabinet 1 form a Helmholtz resonator. In this Helmholtz resonator, an air resonance phenomenon is caused by an air spring of the cabinet 1 as a closed cavity and an air mass in the sound path 7 of the resonance port 8. The resonance frequency $f_{OP}$ is given by the above-mentioned equation (1).

In the acoustic apparatus of this embodiment, the converter 3 is connected to a vibrator driver 30. The vibrator driver 30 comprises a servo unit 31 for performing an electrical servo so as to cancel an air reaction from the resonator when the Helmholtz resonator constituted by the cabinet 1 and the resonance port 8 is driven. As the servo system, a known circuit, such as a negative impedance generator for equivalently generating a negative impedance component ($-Z_O$) in an output impedance, a motional feedback (MFB) circuit for detecting a motional signal corresponding to the behavior of the diaphragm 2 and negatively feeding back to the input side by a proper means, or the like may be employed.

The operation of the acoustic apparatus shown in FIG. 1 will be described below.

When a drive signal is supplied from the diaphragm driver 30 to the vibrator 4, the converter 3 electromechanically converts the drive signal to reciprocate the diaphragm 2 in the back-and-forth direction (right-and-left direction in FIG. 1). The diaphragm 2 mechano-acoustically converts the reciprocal movement. The front surface side (right surface side in FIG. 1) of the diaphragm 2 constitutes a direct radiation portion for directly externally radiating an acoustic wave, and the rear surface side (left surface side in FIG. 1) of the diaphragm 2 constitutes a resonator driving portion for driving the Helmholtz resonator constituted by the cabinet 1 and the resonance port 8. Although an air reaction from the air in the cabinet 1 acts on the rear surface side of the diaphragm 2, the vibrator driver 30 drives the vibrator 4 to cancel the air reaction.

In this manner, since the vibrator 4 is driven to cancel the air reaction from the resonator when the Helmholtz resonator is driven, the diaphragm 2 cannot be driven from the side of the resonator, and serves as a rigid body, i.e., a wall. Therefore, the resonance frequency and the Q value of the Helmholtz resonator are independent from those of the vibrator 4 as the direct radiation portion, and the resonator drive energy from the vibrator 4 is given independently of the direct radiation portion. Since the vibrator 4 is driven in a so-called "dead" state wherein it is not influenced by the air reaction from the resonator, i.e., the cabinet 1, the frequency characteristics of a directly radiated acoustic wave are not influenced by the volume of the cabinet 1. Therefore, according to the arrangement of this embodiment, the volume of the cabinet 1 as the cavity of the Helmholtz resonator can be reduced as compared to a conventional bass-reflex speaker system. In this case, if the resonance frequency $f_{OP}$ is set to be lower than that of the conventional bass-reflex speaker system, a sufficiently high Q value can be set. As a result, in the acoustic apparatus shown in FIG. 1, if the cabinet 1 is reduced in size as compared to the bass-reflex speaker system, reproduction of lower bass sounds can be performed.

In FIG. 1, the converter 3 drives the diaphragm 2 in response to the drive signal from the vibrator driver 30, and independently supplies drive energy to the Helmholtz resonator constituted by the cabinet 1 and the resonance port 8. Thus, an acoustic wave is directly radiated from the diaphragm 2 as indicated by an arrow a in FIG. 1. At the same time, air in the cabinet 1 is resonated, and an acoustic wave having a sufficient sound pressure can be resonantly radiated from the resonance radiating portion (opening 6) as indicated by an arrow b in FIG. 1. By adjusting an air equivalent mass in the sound path 7 of the resonance port 8 in the Helmholtz resonator, the resonance frequency $f_{OP}$ is set to be lower than a reproduction frequency range of the converter 3, and by adjusting an equivalent resistance of the sound path 7 to set the Q value to be an optimal level, a sound pressure of a proper level can be obtained from the opening 6. Under these conditions, the frequency characteristics of a sound pressure shown in, e.g., FIG. 2 can be obtained.

The Helmholtz resonator is present as a virtual woofer which performs acoustic radiation quite independently of the vibrator 4. Although the virtual woofer is realized by a small diameter corresponding to the port diameter, it corresponds to one having a considerably large diameter. In addition, its diaphragm is constituted by air, and the virtual speaker is an ideal speaker free from an amplitude distortion.

As can be seen from equation (1), the resonance frequency $f_{OP}$ of the Helmholtz resonator can be set by appropriately selecting a ratio of the sectional area S of the sound path 7 to the length l with respect to an arbitrary volume V of the cabinet 1. Therefore, if the length of the resonance port 8 is determined while the ratio is constant, the opening portion 6 can be set at a desired position.

Modifications

FIGS. 3 to 8 show modifications of the resonance port shown in FIG. 1.

Figure 3:
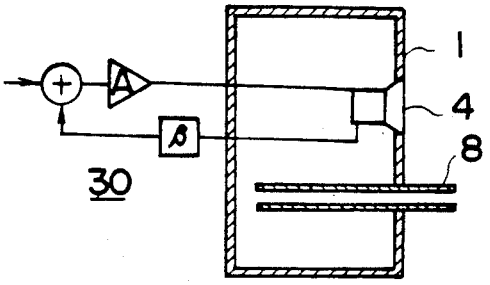
FIGS. 3 to 8 are sectional views showing modifications of a resonance port shown in FIG. 1.

FIG. 3 shows a modification wherein the length of the resonance port 8 is larger than the depth of the cabinet 1 in a conventional bass-reflex speaker system. In this case, the trailing end portion of the resonance port 8 is separated from the inner surface of the cabinet 1 by at least a distance corresponding to the inner diameter of the resonance port 8, and a portion of the resonance port 8, which cannot be housed in the cabinet 1, externally projects from the cabinet 1.

Figure 4:
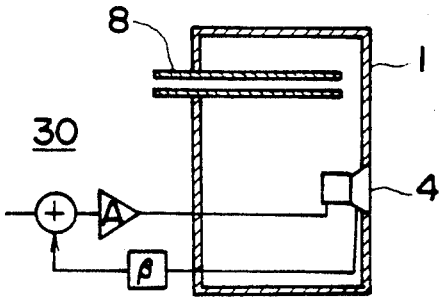

FIG. 4 shows a modification wherein the resonance port 8 projects from the rear surface of the cabinet 1, while the resonance port 8 projects from the front surface of the cabinet 1 in the system shown in FIG. 3.

Figure 5:
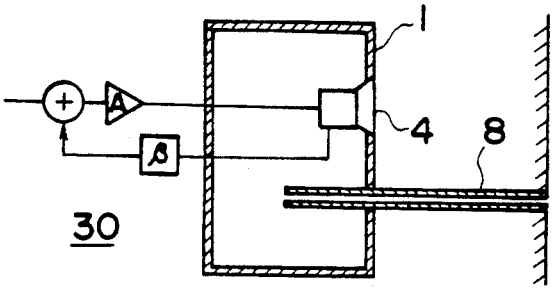

FIG. 5 shows a modification wherein the resonance port 8 is open to a chamber separated from a chamber in which the cabinet 1 and the vibrator 4 are arranged.

Figure 6:
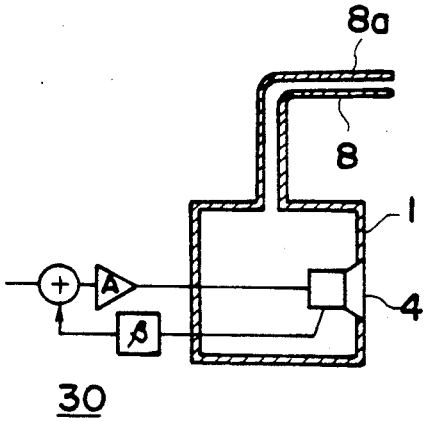
Figure 8:
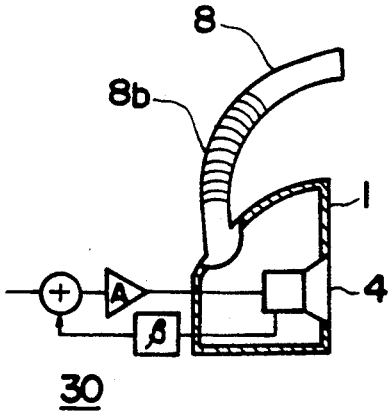

FIG. 6 shows a modification wherein the resonance port 8 in the system shown in FIG. 8 is bent in an L shape.

Figure 7:
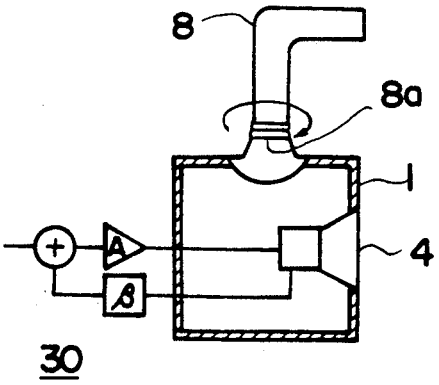

FIG. 7 shows a modification wherein the L-shaped resonance port 8 shown in FIG. 6 is arranged to be pivotal about a mounting portion 8*a* mounted to the cabinet 1.

FIG. 8 shows a modification wherein the resonance port comprises a flexible port whose central portion 8*b* is formed of a flexible tube.

According to the arrangements shown in FIGS. 7 and 8, the opening portion of the resonance port 8, i.e., the virtual woofer, can be set at a desired position and in a desired direction depending on a reproduction environment.

Second Embodiment

FIG. 9A shows a basic arrangement of an acoustic apparatus according to a second embodiment of the present invention. In the acoustic apparatus shown in FIG. 9A, a felt annular member 9 is attached to an outer opening portion (air opening portion) of the resonance port 8, and a felt annular member 9′ is attached to an inner opening portion (opening portion opposing the inner surface of the cabinet) in addition to the arrangement of the acoustic apparatus shown in FIG. 1, so that changes in boundary condition near the two end opening portions of the resonance port 8 are moderated. FIGS. 9B and 9C are perspective views of the annular members 9 and 9′, respectively.

In the acoustic apparatus shown in FIG. 9A, since a sufficient lower bass sound can be radiated from the opening 6 of the resonance port 8, a considerably high speed air flow for supplying this acoustic energy is generated in the resonance port 8. In the apparatus shown in FIG. 1 which has no felt annular members 9 and 9′, when the air flow passing through the resonance port 8 is exhausted outside the port, a condition before and after the opening 6 portion as a boundary is immediately changed, as shown in FIG. 10B. Thus, a turbulent flow and vortex flow are generated, and are sensed as noise in some cases, thus degrading the quality of the acoustic apparatus. However, in the second embodiment, the felt annular members 9 and 9′ are arranged at the inner and outer boundary portions of the resonance port 8, a change in condition at the boundary portion can be moderated by air permeability and an acoustic resistance of the felt, as shown in FIG. 10A, thus preventing noise caused by the turbulent sound and the like.

The annular members 9 and 9′ are fitted on the outer surface side of the resonance port 8 in FIGS. 9, 10A, and the like, but may be fitted on the inner surface side of the resonance port 8.

FIGS. 11A, 11B, and 11C and FIGS. 12A and 12B show modifications of a boundary condition change buffer means corresponding to the annular members 9 and 9′ shown in FIG. 9.

Figure 11C:
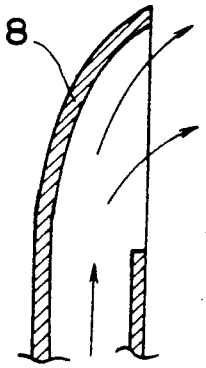
FIGS. 11A to 12B are views showing modifications of the second embodiment.
Figure 11B:
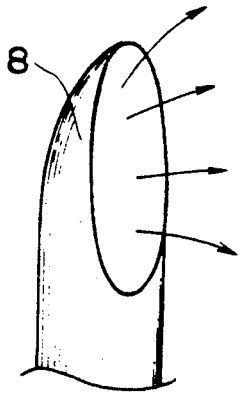
Figure 11A:
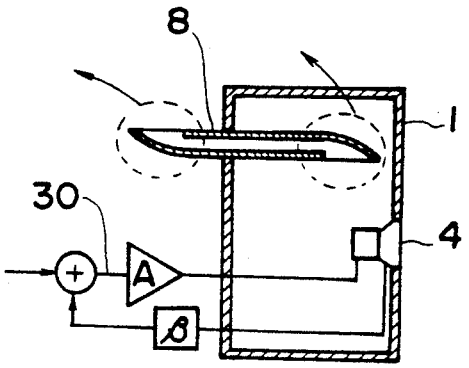

In the boundary condition change buffer means shown in FIGS. 11A, 11B, and 11C, the shape of each distal end of the resonance port 8 is modified to moderate a change in boundary condition. In this modification, the opening portion is formed in a side surface so as not to influence the acoustically equivalent opening area S, and the sectional area of the resonance port 8 is gradually increased toward this opening portion. FIG. 11A is a sectional view showing the entire structure, FIG. 11B shows an enlarged sectional view of the opening portion of the resonance port, and FIG. 11C is a sectional view of FIG. 11B.

Figure 12A:
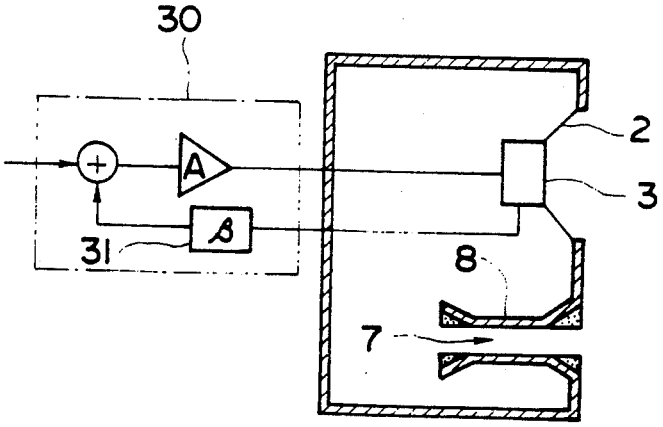
Figure 12B:
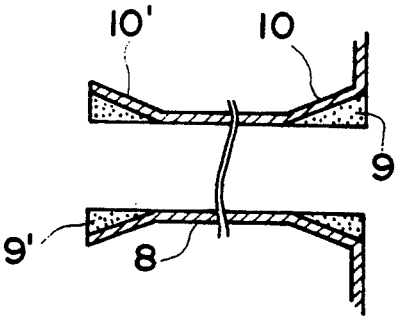
Figure 13A:
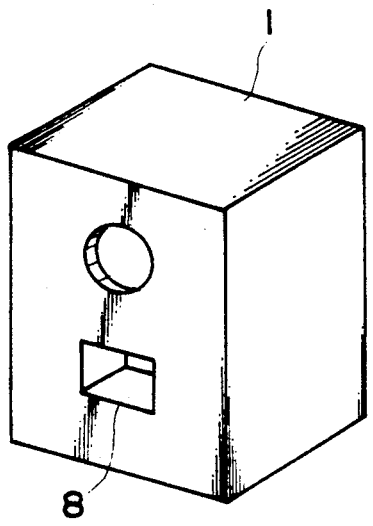
FIG. 13A PRIOR ART
FIGS. 13A and 13B are respectively a perspective view and a sectional view showing an arrangement of a conventional bass-reflex speaker system.
Figure 13B:
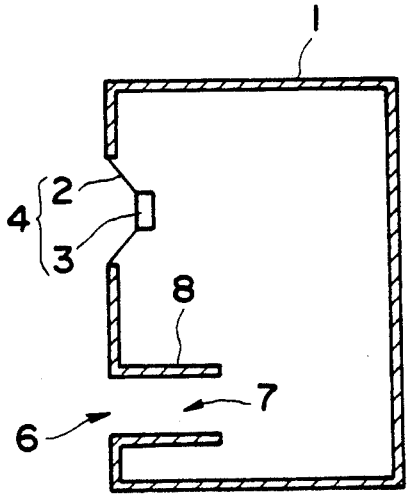
FIG. 13B PRIOR ART
Figure 14:
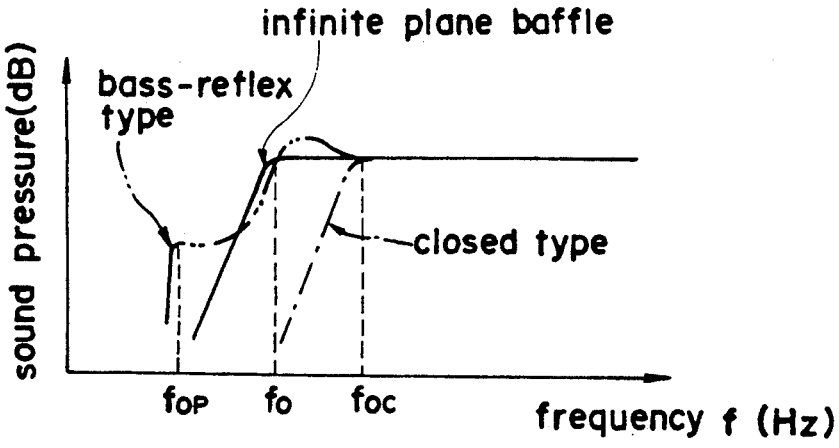
FIG. 14 PRIOR ART
FIG. 14 is a graph for explaining sound pressure characteristics of the speaker system shown in FIGS. 13A and 13B.

FIGS. 12A and 12B show a modification wherein the resonance port 8 is embedded in the cabinet 1 like in the conventional bass-reflex system. In this modification, the two end opening portions of the resonance port 8 are tapered to form tapered portions 10 and 10′, and the felt annular members 9 and 9′ are fitted on the inner surface of the tapered portions 10 and 10′. Thus, using the annular members 9 and 9′, an apparent sectional area of the resonance port 8 is entirely made constant, and changes in boundary condition at the opening portions can be moderated. FIG. 12A is a sectional view showing the entire system, and FIG. 12B is an enlarged sectional view of the opening portion of the resonance port.

Regarding the material of the annular members 9 and 9′, materials having air permeability and an acoustic resistance, such as sponge, unwoven fabric, fabric, and the like may be used in place of felt. In the following description, felt, sponge, unwoven fabric, fabric and the like are called felt and the like. Note that when unwoven fabric or fabric is used as the felt and the like, these materials need not be formed into a cylindrical shape as described above but are formed into a belt-like shape, and are wound in a corresponding amount on the resonance port 8. The annular members 9 and 9′ may be formed of a material having flexibility and viscoelasticity, e.g., rubber in place of the felt and the like. Such a material having flexibility and viscoelasticity exhibits a function essentially equivalent to the air permeability of the felt and the like. In addition, the material serves as a resistance for consuming energy when it is flexed due to its viscoelasticity.

In the above embodiments and modifications, the boundary condition change buffer means are arranged at two end opening portions of the resonance port 8. However, since the turbulent sound and the like is offensive to ears at the outer opening portion directly communicating with air, the buffer means may be arranged at only the air opening portion, thus providing a practical advantage.

What is claimed is:

1. An acoustic apparatus comprising:

an enclosure having an internal cavity defining a Helmholtz resonator, and a resonance duct that together with the enclosure radiates an acoustic wave by resonance, wherein the resonance duct externally projects from the enclosure;

a vibrator supported by the enclosure and having a diaphragm including a direct radiation portion for directly radiating an acoustic wave and a resonator driver portion for driving the Helmholtz resonator; and means for driving the vibrator to substantially cancel an air reaction from the resonator, the means for driving including a servo circuit for varying drive of the vibrator in accordance with feedback from the vibrator.

2. An acoustic apparatus according to claim 1, wherein said resonance duct has a longitudinal axis and is longer than an interior dimension of the enclosure coincident with said longitudinal axis.

3. An acoustic apparatus according to claim 1, wherein said resonance duct is movable with respect to the enclosure.

4. An acoustic apparatus according to claim 1, wherein said means for driving the vibrator drives said vibrator so as to enable the vibrator and the Helmholtz resonator to be driven independently of each other.

* * * * *